US005497875A

United States Patent [19]

Kuo

[11] Patent Number: 5,497,875

[45] Date of Patent: Mar. 12, 1996

[54] BOXED TRAVELING ITEM

[76] Inventor: Jack C. Kuo, No. 8, Yih Li Street, Pei Tou, Taipei, Taiwan

[21] Appl. No.: 383,585

[22] Filed: Feb. 3, 1995

[51] Int. Cl.[6] ..... G04B 37/14

[52] U.S. Cl. ..... 206/45.13; 206/301; 368/276; 968/DIG. 1

[58] Field of Search ..... 206/18, 70, 301, 206/45.13, 45.15, 45.18; 368/226, 227, 316, 317; 968/DIG. 1

[56] References Cited

U.S. PATENT DOCUMENTS

| | | | |
|---|---|---|---|
| 1,964,334 | 6/1934 | Verger et al. | 206/45.15 |
| 2,013,575 | 9/1935 | Moffatt | 206/45.18 |
| 2,158,155 | 5/1939 | Roy | 206/45.15 |
| 2,567,564 | 9/1951 | Ingraham | 206/18 |

FOREIGN PATENT DOCUMENTS

| | | | |
|---|---|---|---|
| 969891 | 12/1950 | France | 206/45.13 |
| 137256 | 3/1930 | Switzerland | 206/301 |
| 138359 | 5/1930 | Switzerland | 206/301 |
| 142515 | 12/1930 | Switzerland | 206/301 |
| 155169 | 8/1932 | Switzerland | 206/301 |

*Primary Examiner*—Jimmy G. Foster
*Attorney, Agent, or Firm*—Bacon & Thomas

[57] ABSTRACT

A boxed traveling item including a casing, a cover hinged to one side of the casing and having a transverse sliding groove and a retaining hole at one end of the transverse sliding groove, a traveling item hinged to the casing by a hinge and received in a storage chamber inside the casing, and torsional springs mounted on the hinge between the casing and the traveling item to automatically lift the traveling item from the storage chamber when the cover is opened, the traveling item having a hooked retainer rod at the free end, which is moved along the transverse sliding groove and hooked into the retaining hole when the cover is opened.

3 Claims, 3 Drawing Sheets

BOXED TRAVELING ITEM

BACKGROUND OF THE INVENTION

The present invention relates to traveling items such as traveling alarm, etc., which is mounted within a box and automatically lifted from a horizontal position to a tilted position by torsional springs when the box is opened.

Various boxed traveling items such as traveling alarms, mirrors, etc., are well known and intensively used by travelers. These boxed traveling items are commonly comprised of a casing, a cover hinged to the casing, and a traveling item hinged to the cover or the casing. When the cover is opened, the traveling item can be lifted by hand and then set in a tilted position supported between the casing and the cover. As the traveling item is disposed in the tilted position by stopping one side against the cover or the casing, it tends to fall from the tilted position when the casing or the cover is vibrated. Therefore, the traveling item tends to be damaged.

SUMMARY OF THE INVENTION

The present invention has been accomplished to provide a boxed traveling item which eliminates the aforesaid problem. According to one aspect of the present invention, the boxed traveling item comprises a casing, a cover hinged to one side of the casing and having a transverse sliding groove and a retaining hole at one end of the transverse sliding groove, a traveling item hinged to the casing by a hinge and received in a storage chamber inside the casing, and torsional springs mounted on the hinge between the casing and the traveling item to automatically lift the traveling item from the storage chamber to a tilted position when the cover is opened, wherein the traveling item has a hooked retainer rod at the free end, which is moved along the transverse sliding groove and hooked into the retaining hole to hold the traveling item in the tilted position when the cover is opened.

According to another aspect of the present invention, the hooked retainer rod of the traveling item has a ball bearing at the top for moving the hooked retainer rod in the sliding groove of the cover smoothly.

DETAILED DESCRIPTION OF THE PREFERRED EMBODIMENT

Figure 1:
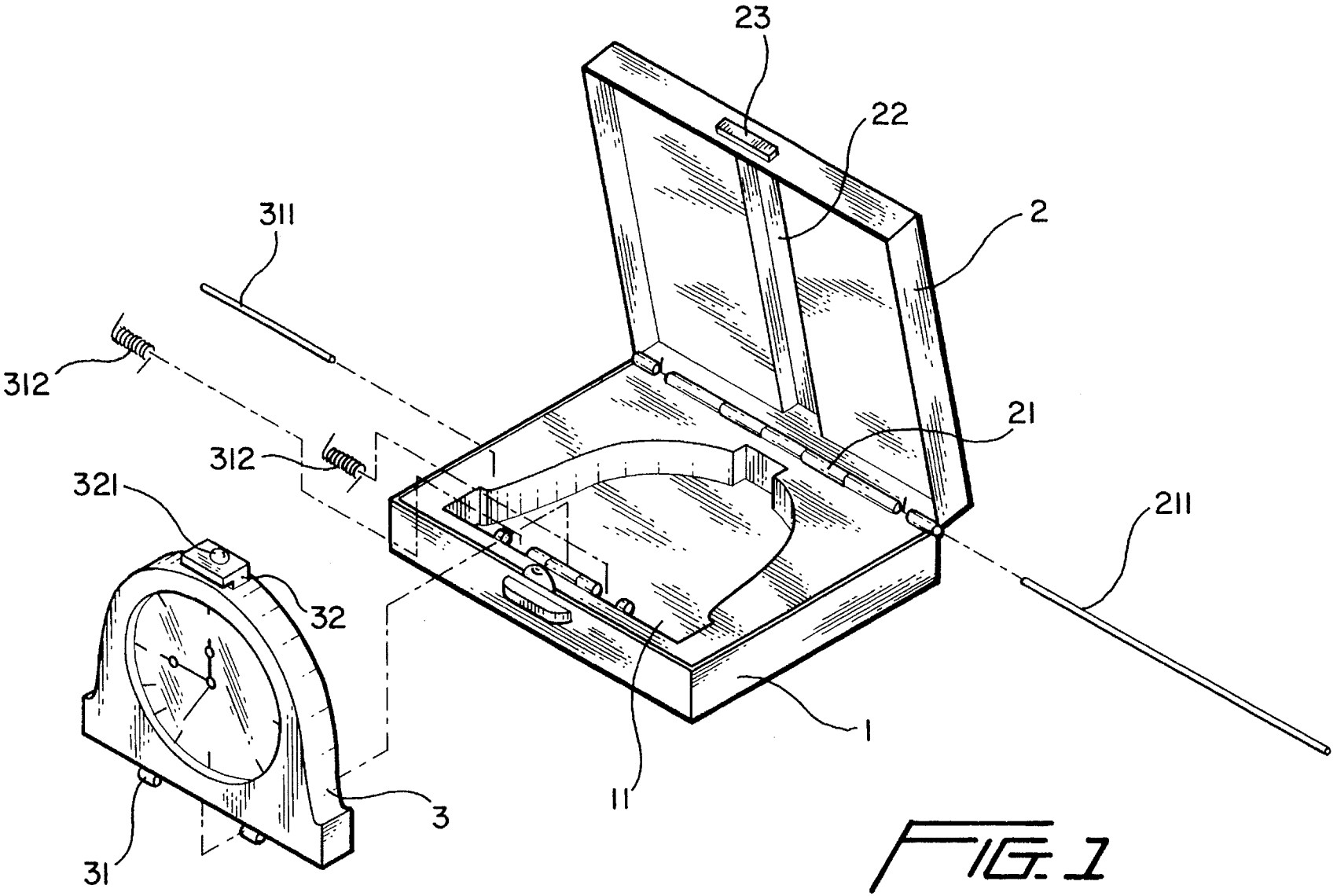
FIG. 1 is an exploded view of a boxed traveling item according to the present invention.

Referring to FIG. 1, a boxed traveling item in accordance with the present invention is generally comprised of a casing 1, a cover 2, and a traveling item 3. The cover 2 has knuckles

Figure 2:
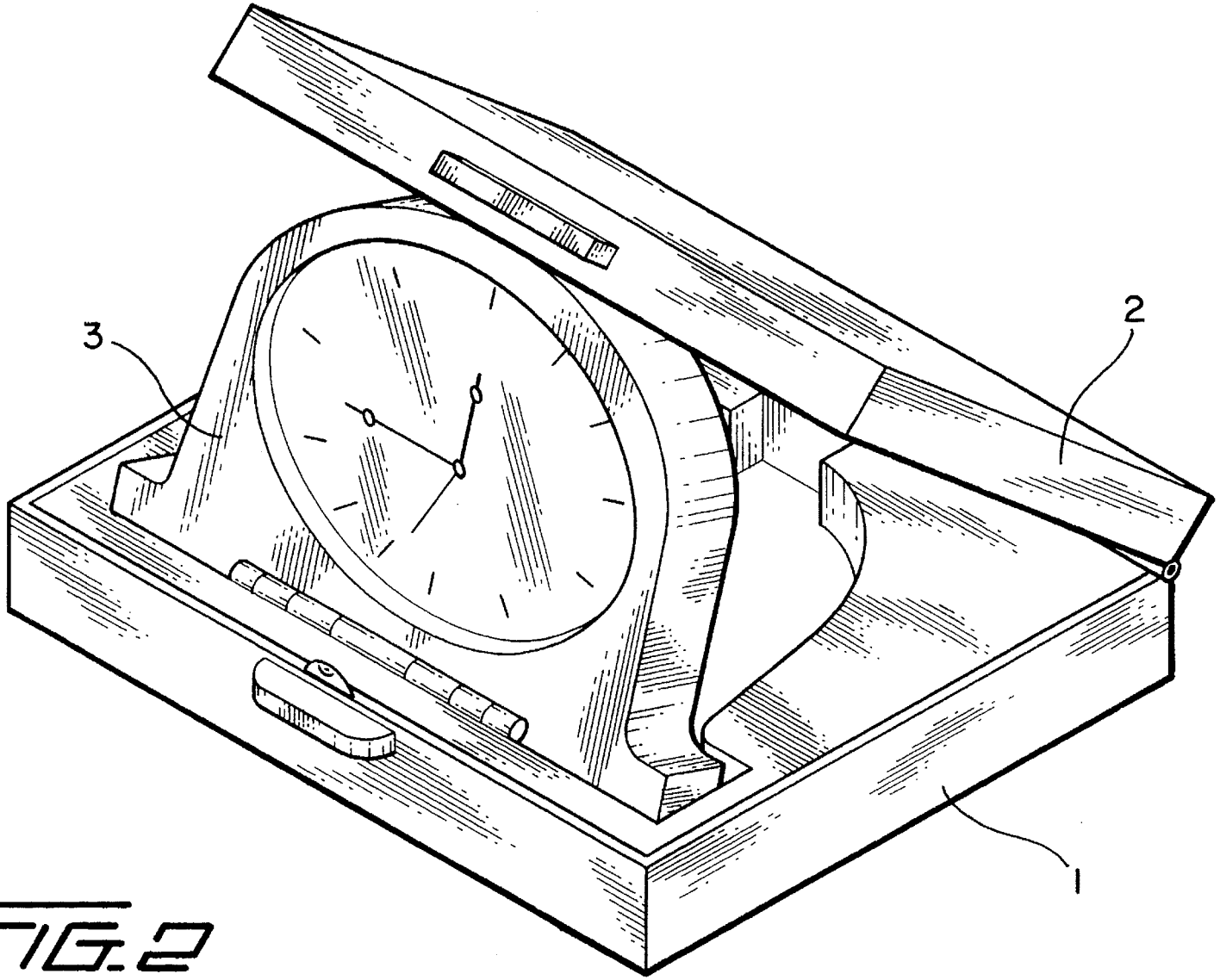
FIG. 2 is an elevational view of the boxed traveling item shown in FIG. 1 when opened.

21 spaced along one side thereof and hinged to one side of the casing 1 by a pivot pin 211, a retaining hole 23 in the middle of an opposite side thereof, and a sliding groove 22 transversely disposed on the inside in the middle between the retaining hole 23 and the knuckles 21. The casing 1 defines a storage chamber 11, which receives the traveling item 3. The traveling item 3 can be a traveling alarm, mirror, picture frame, etc., having a hooked retainer rod 32 at the top side and a plurality of knuckles 31 at the bottom side. The hooked retainer rod 32 has a ball bearing 321 at the top, which is moved along the sliding groove 22 of the cover 2 when the user opens or closes the cover 2. The knuckles 31 are hinged to one side of the casing 1 remote from the hinged side between the cover 2, by a pivot pin 311 and torsional springs 312. The torsional springs 312 give an outward pressure to the traveling item 3 to lift it from the storage chamber 11 into a tilted position when the cover 2 is opened (see FIG. 2).

Figure 4:
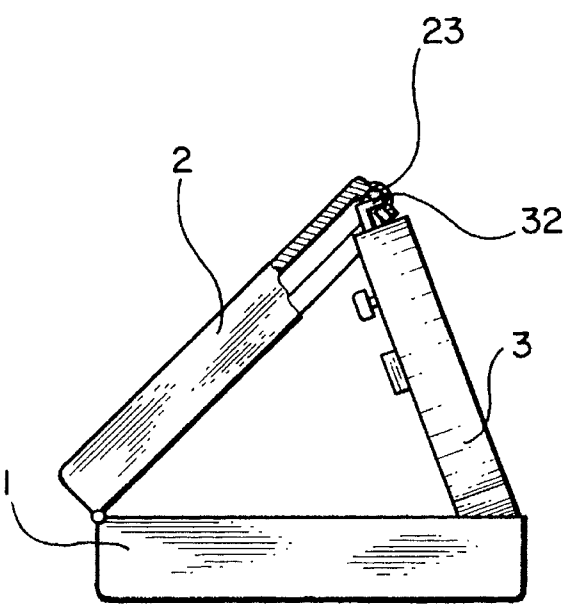
FIG. 4 is side view partially in section of FIG. 2, showing the hooked retainer rod of the traveling item hooked in the retaining hole on the cover.
Figure 3:
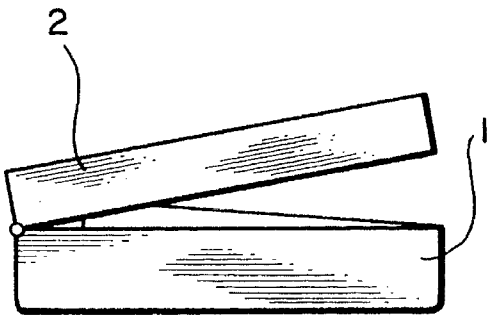
FIG. 3 is a side view of the boxed traveling item shown in FIG. 1 when initially opened.

Referring to FIGS. 3 and 4, when the cover 2 is opened from the casing 1, the torsional springs 312 automatically force the traveling item 3 to turn about the pivot pin 311, causing the ball bearing 321 moved along the sliding groove 22. When the ball bearing 321 is moved upwards to the limit, the hooked retainer rod 32 is forced into the retaining hole 23 to hold the traveling item 3 in a tilted position. On the contrary, when the traveling item 3 is pushed backwards, the hooked retainer rod 32 becomes disconnected from the retaining hole 23, and therefore the traveling item 3 can be moved back and received within the storage chamber 11.

Figure 5:
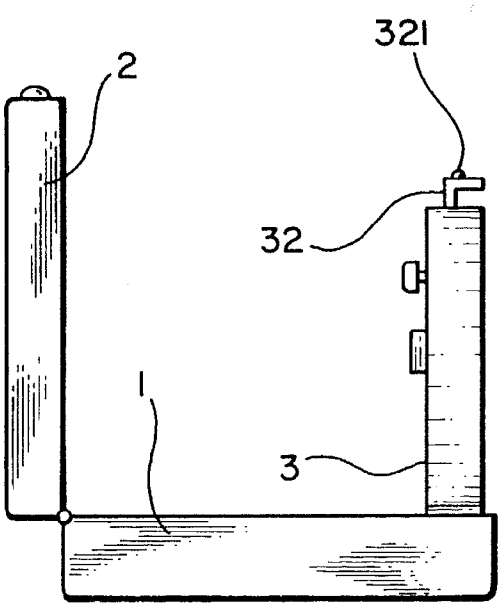
FIG. 5 is another side view of the boxed traveling item shown in FIG. 1, showing the cover disconnected from the traveling item.

Referring to FIG. 5, by holding the cover 2 with one hand and pushing the traveling item 3 inwards with the other hand, the cover 2 can be disconnected from the hooked retainer rod 32 of the traveling item 3, permitting the traveling item 3 to be moved to a vertical position perpendicular to the casing 1 for operating the adjustment knobs on the back side of the traveling item 3.

While only one embodiment of the present invention has been shown and described, it will be understood that various modifications and changes could be made without departing from the spirit and scope of the invention.

What is claimed is:

1. A boxed traveling item comprising a casing defining a storage chamber, a cover hinged to one side of said casing, and a traveling item received in said storage chamber, wherein said cover has a sliding groove transversely disposed at an inner side; said traveling item has a bottom side hinged to an inner side of said casing by a hinge and a top side mounted with a hooked retainer rod, said hinge being mounted with torsional springs, which force said traveling item from a horizontal position received inside said storage chamber to a tilted position, said hooked retainer rod being moved along said sliding groove when said cover is moved relative to said casing.

2. The boxed traveling item of claim 1 wherein said hooked retainer rod has a ball bearing at a top side thereof for moving said hooked retainer rod in said sliding groove.

3. The boxed traveling item of claim 1 wherein said cover has a retaining hole adjacent to one end of said sliding groove; said hooked retainer rod of said traveling item is hooked in said retaining hole when said cover is opened and said traveling item is moved by said torsional springs to said tilted position.

* * * * *